US009254972B2

(12) United States Patent
Ukai

(10) Patent No.: US 9,254,972 B2
(45) Date of Patent: Feb. 9, 2016

(54) IMAGE PROCESSING APPARATUS

(71) Applicant: BROTHER KOGYO KABUSHIKI KAISHA, Nagoya-shi, Aichi-ken (JP)

(72) Inventor: Shinji Ukai, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/507,255

(22) Filed: Oct. 6, 2014

(65) Prior Publication Data

US 2015/0097329 A1 Apr. 9, 2015

(30) Foreign Application Priority Data

Oct. 8, 2013 (JP) ..... 2013-210885

(51) Int. Cl.
*B65H 1/04* (2006.01)

(52) U.S. Cl.
CPC ..... *B65H 1/04* (2013.01); *B65H 2402/46* (2013.01); *B65H 2405/111643* (2013.01); *B65H 2405/111646* (2013.01); *B65H 2405/324* (2013.01); *B65H 2511/12* (2013.01); *B65H 2511/22* (2013.01); *B65H 2801/39* (2013.01)

(58) Field of Classification Search
CPC ..... B65H 2511/12; B65H 2405/1111; B65H 2405/1116; B65H 2405/11162; B65H 2405/11164; B65H 2405/111646
USPC ..... 271/171
See application file for complete search history.

(56) References Cited

U.S. PATENT DOCUMENTS

| | | | | |
|---|---|---|---|---|
| 6,056,286 | A * | 5/2000 | Koga | 271/145 |
| 6,916,020 | B2 * | 7/2005 | Hasegawa | 271/171 |
| 8,430,398 | B2 * | 4/2013 | Kamichi | 271/171 |
| 8,602,410 | B2 | 12/2013 | Kuriki | |

FOREIGN PATENT DOCUMENTS

JP 2010-222132 A 10/2010

* cited by examiner

*Primary Examiner* — Jeremy R Severson
(74) *Attorney, Agent, or Firm* — Merchant & Gould PC

(57) ABSTRACT

An image processing apparatus including a first guide configured in one of a first manner that the first guide is disposed on a first tray surface of a first tray and extends in a first direction perpendicular to a rotational axis of a second tray and parallel to the first tray surface, and a second manner that the first guide is disposed on a second tray surface of the second tray and extends in a second direction perpendicular to the rotational axis of the second tray and parallel to the second tray surface, and a second guide connected with the first guide, so as to move between a first position where the second guide faces the first tray surface in a direction perpendicular to the first tray surface and a second position where the second guide faces the second tray surface in a direction perpendicular to the second tray surface.

20 Claims, 14 Drawing Sheets

IMAGE PROCESSING APPARATUS

CROSS-REFERENCE TO RELATED APPLICATION

This application claims priority under 35 U.S.C. §119 from Japanese Patent Application No. 2013-210885 filed on Oct. 8, 2013. The entire subject matters of the applications are incorporated herein by reference.

BACKGROUND

1. Technical Field

The following description relates to one or more techniques for an image processing apparatus.

2. Related Art

An image reader has been known that includes a feed tray configured to support one or more sheets placed thereon. The feed tray is attached to an apparatus main body via a hinge in a manner openable and closable relative to the apparatus main body. When the feed tray is open, a sheet feeding port formed at the apparatus main body is open. Then, the sheets are placed to straddle both a tray surface of the feed tray and a lower surface that forms a lower end portion of the sheet feeding port. Further, when closed, the feed tray is placed on an upper surface of the apparatus main body so as to overlap the apparatus main body and cover the sheet feeding port.

The feed tray includes guides that are rotatably provided on the tray surface and configured to regulate positions of the sheets in a width direction of the sheets. A rotational axis of each guide extends in a direction perpendicular to a rotational axis of the feed tray and parallel to the tray surface of the feed tray. Each guide is configured to rotate around the corresponding rotational axis, between a position where the guide stands up from the tray surface and another position where the guide falls down on the tray surface.

SUMMARY

However, the guides are provided only on the tray surface of the feed tray but not provided on the lower surface that forms the lower end portion of the sheet feeding port. Therefore, the guides are not long enough to adequately guide the sheets. Consequently, the sheets might be fed forward obliquely (with an undesired skew angle).

Aspects of the present disclosure are advantageous to provide one or more improved techniques, for an image processing apparatus, which make it possible to improve a sheet guiding function.

According to aspects of the present disclosure, an image processing apparatus is provided, which includes a housing, an image processing unit disposed in the housing, a first tray disposed at the housing, the first tray having a first tray surface, a second tray rotatably supported by the first tray, the second tray having a second tray surface, a first guide configured in one of a first manner that the first guide is disposed on the first tray surface and extends in a first direction, the first direction being perpendicular to a rotational axis of the second tray and parallel to the first tray surface, and a second manner that the first guide is disposed on the second tray surface and extends in a second direction, the second direction being perpendicular to the rotational axis of the second tray and parallel to the second tray surface, and a second guide connected with the first guide, the second guide being configured to move between a first position where the second guide faces the first tray surface in a direction substantially perpendicular to the first tray surface and a second position where the second guide faces the second tray surface in a direction substantially perpendicular to the second tray surface.

According to aspects of the present disclosure, further provided is an image processing apparatus including a housing, an image processing unit disposed in the housing, a first tray disposed at the housing, the first tray having a first tray surface, a second tray rotatably supported by the first tray, the second tray having a second tray surface, a first guide disposed on the first tray surface, the first guide extending in a first direction perpendicular to a rotational axis of the second tray and parallel to the first tray surface, and a second guide connected with the first guide, the second guide being configured to rotate around a rotational axis extending in a direction substantially perpendicular to the first tray surface, between a first position where the second guide faces the first tray surface in the direction substantially perpendicular to the first tray surface and a second position where the second guide faces the second tray surface in a direction substantially perpendicular to the second tray surface.

BRIEF DESCRIPTION OF THE ACCOMPANYING DRAWINGS

a direction that is perpendicular to the rotational axis 17 and along the first tray surface 35 will be defined as a first direction.

Figure 5:
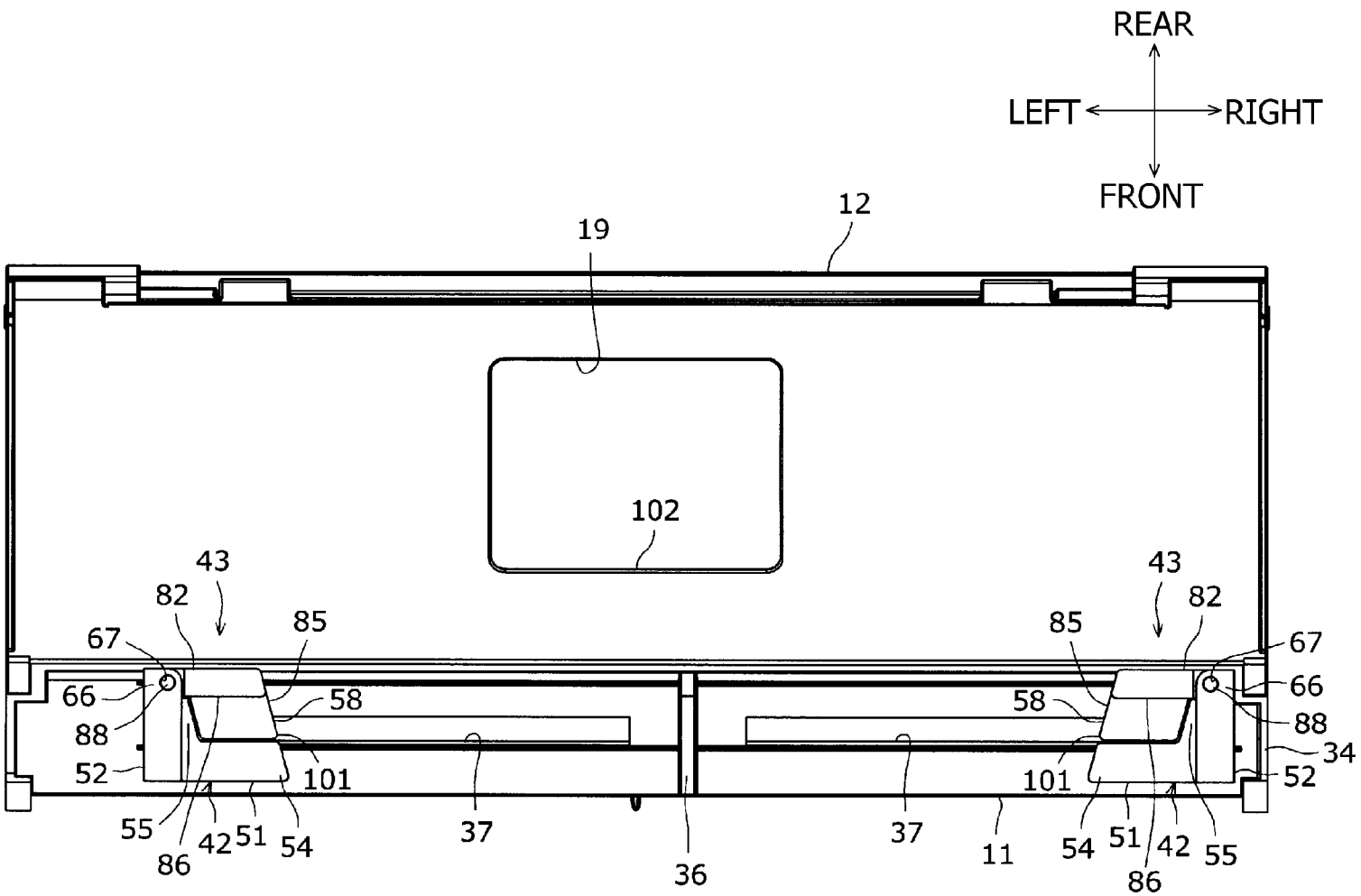

FIG. 5 is a top view showing the first tray and the second tray when the second guides are in their respective retracted positions in the illustrative embodiment according to one or more aspects of the present disclosure.

Figure 6:
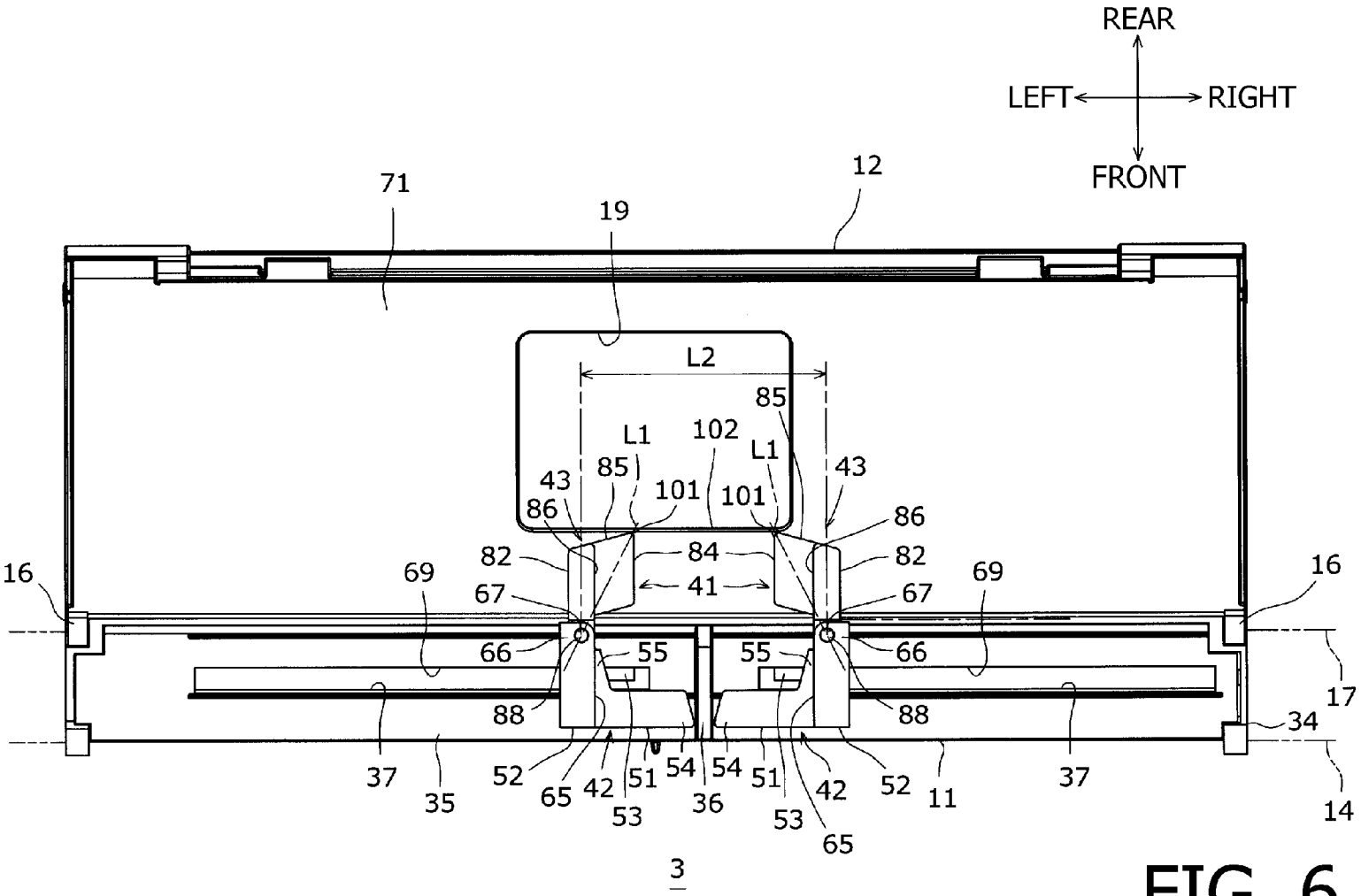

FIG. 6 is a top view showing the first tray and the second tray when the second guides are in their respective usage positions, and two width guides are closest to each other in a left-to-right direction, in the illustrative embodiment according to one or more aspects of the present disclosure.

Figure 7:
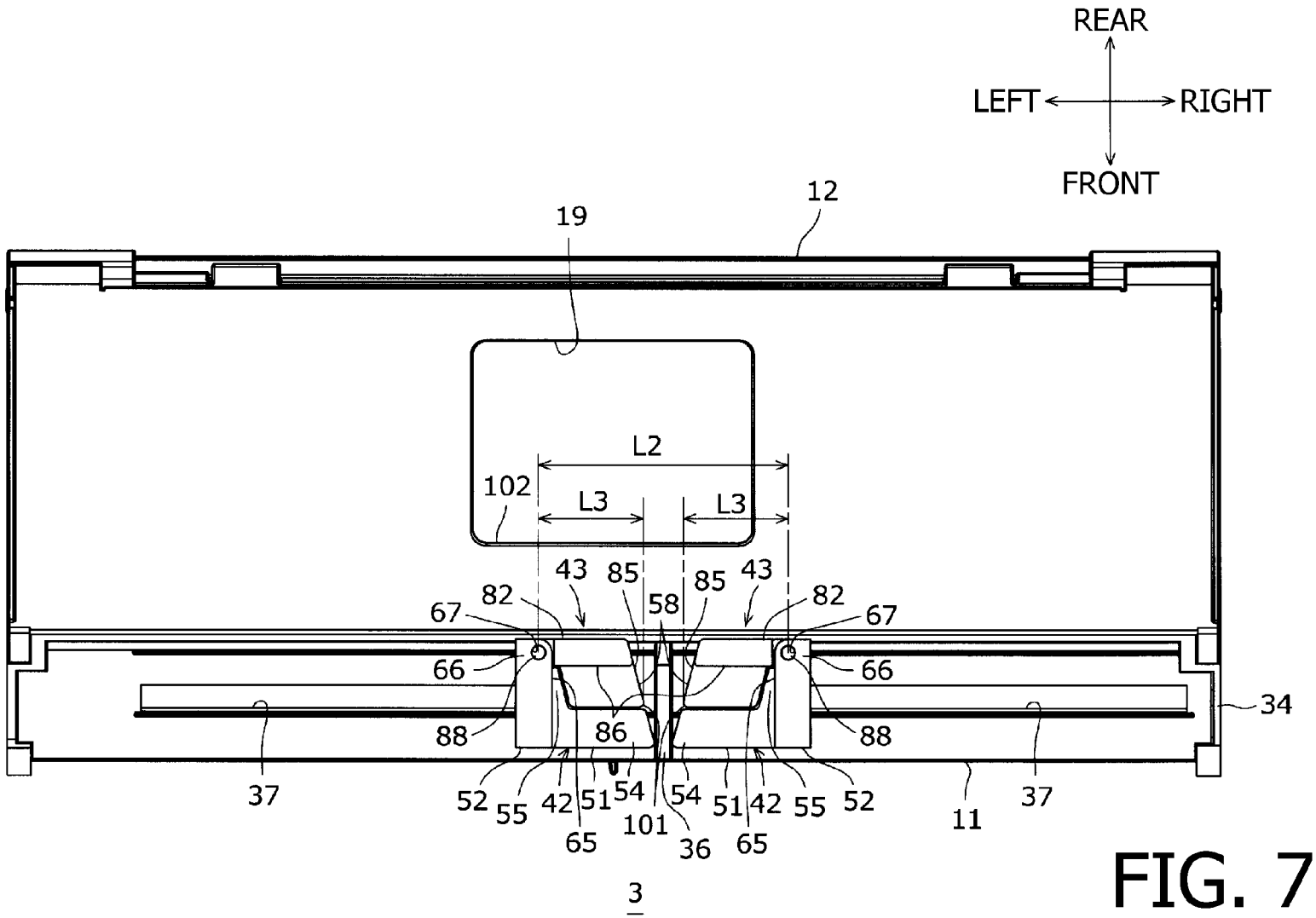

FIG. 7 is a top view showing the first tray and the second tray when the second guides are in their respective retracted positions, and the two width guides are closest to each other in a left-to-right direction, in the illustrative embodiment according to one or more aspects of the present disclosure.

Figure 8:
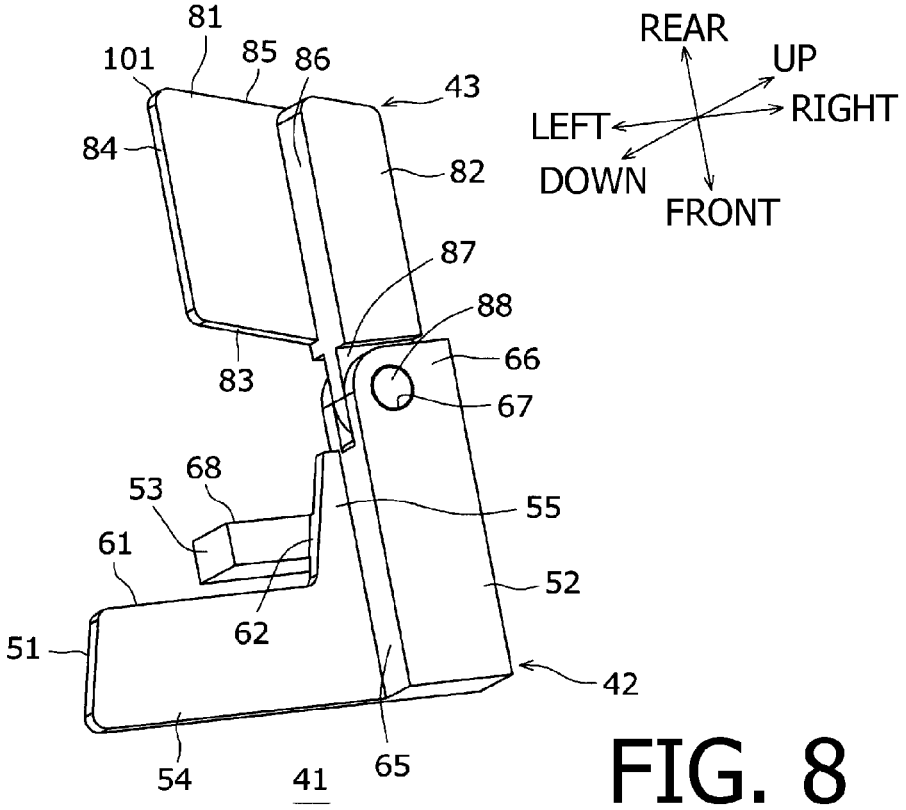

FIG. 8 is a perspective view showing the right wide guide when the corresponding second guide is in the usage position, with the front-to-rear direction as the direction perpendicular to the rotational axis of the second tray and along the first tray surface of the first tray, in the illustrative embodiment according to one or more aspects of the present disclosure.

Figure 9:
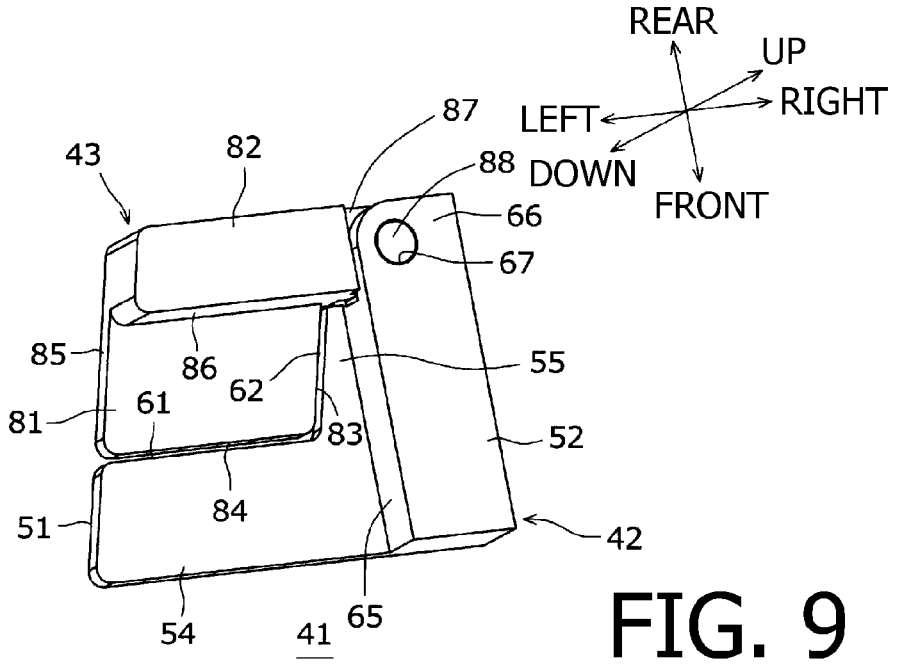

FIG. 9 is a perspective view showing the right wide guide when the corresponding second guide is in the retracted position, with the front-to-rear direction as the direction perpendicular to the rotational axis of the second tray and along the first tray surface of the first tray, in the illustrative embodiment according to one or more aspects of the present disclosure.

Figure 10:
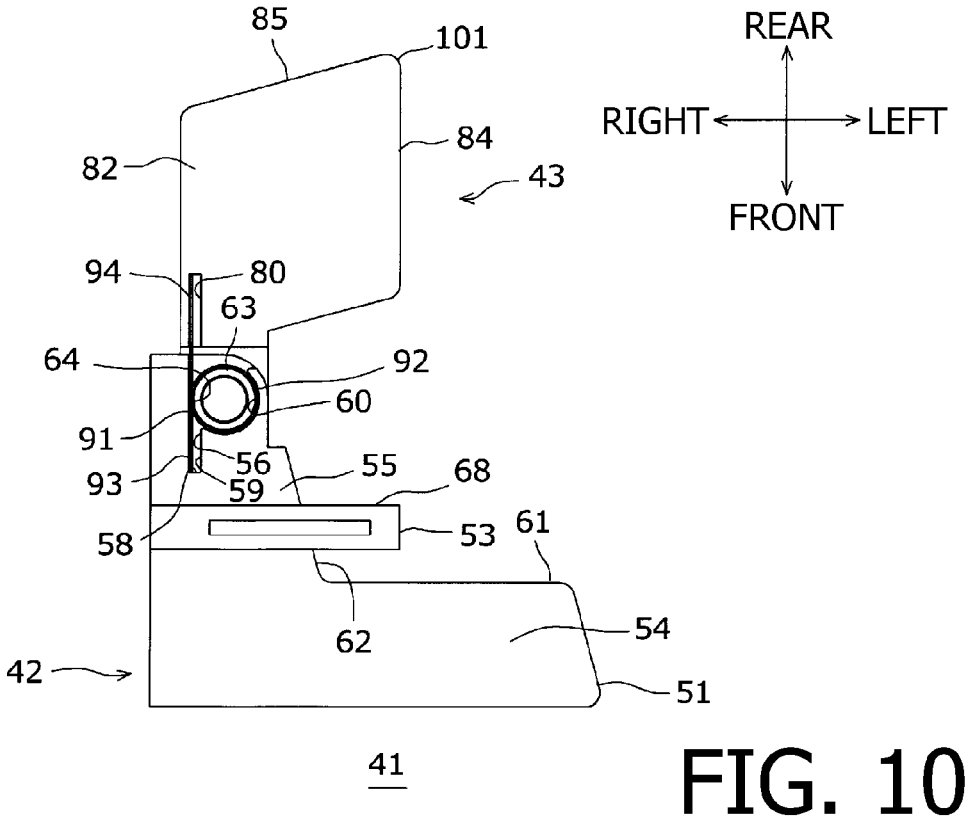

FIG. 10 is a bottom view showing the right wide guide when the corresponding second guide is in the usage position, with the front-to-rear direction as the direction perpendicular to the rotational axis of the second tray and along the first tray surface of the first tray, in the illustrative embodiment according to one or more aspects of the present disclosure.

Figure 11:
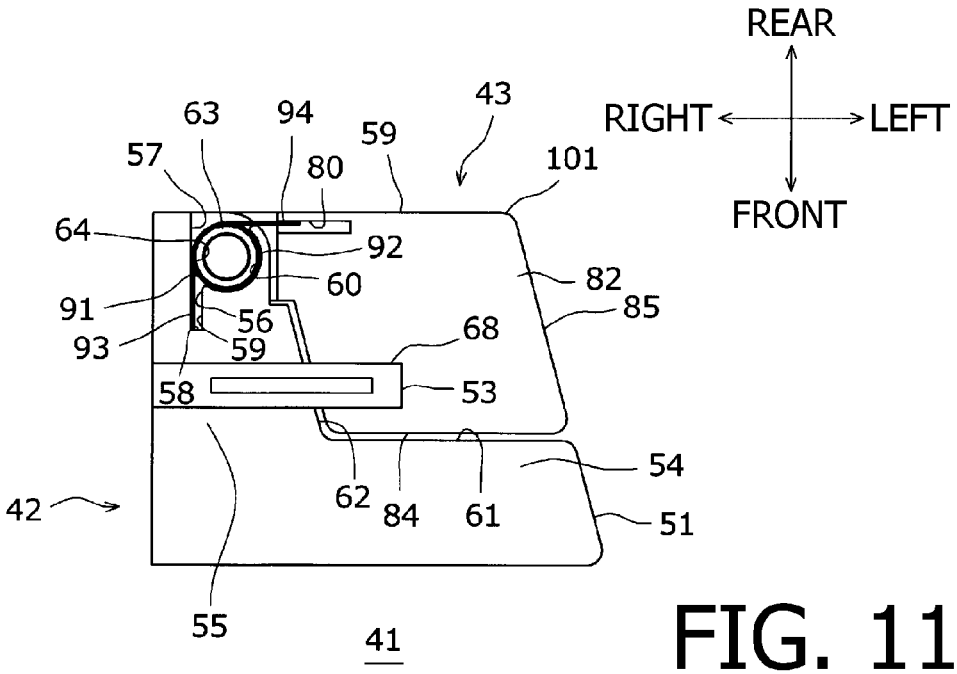

FIG. 11 is a bottom view showing the right wide guide when the corresponding second guide is in the retracted position, with the front-to-rear direction as the direction perpendicular to the rotational axis of the second tray and along the first tray surface of the first tray, in the illustrative embodiment according to one or more aspects of the present disclosure.

Figure 12:
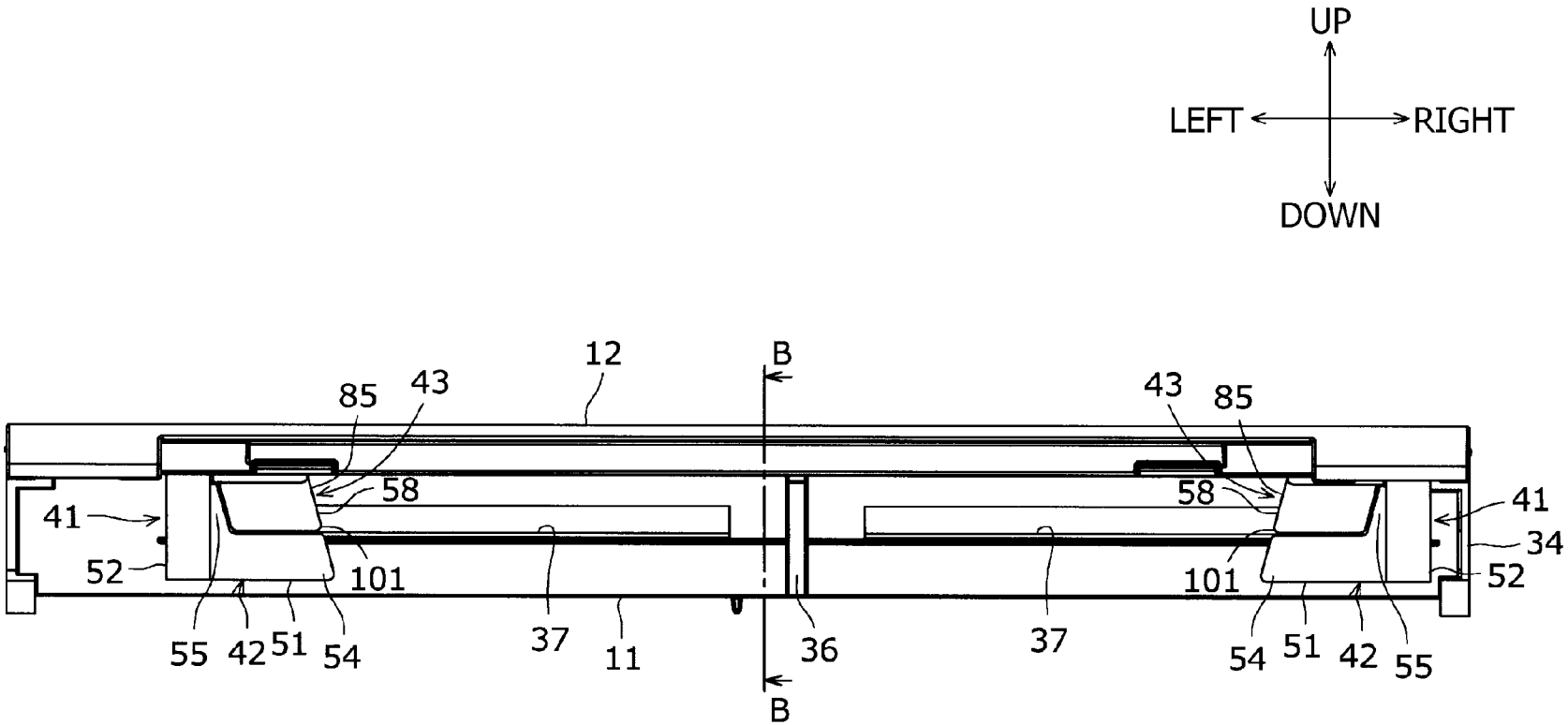

FIG. 12 is a front view showing the first tray and the second tray when the tray is in the closed position in the illustrative embodiment according to one or more aspects of the present disclosure.

Figure 13:
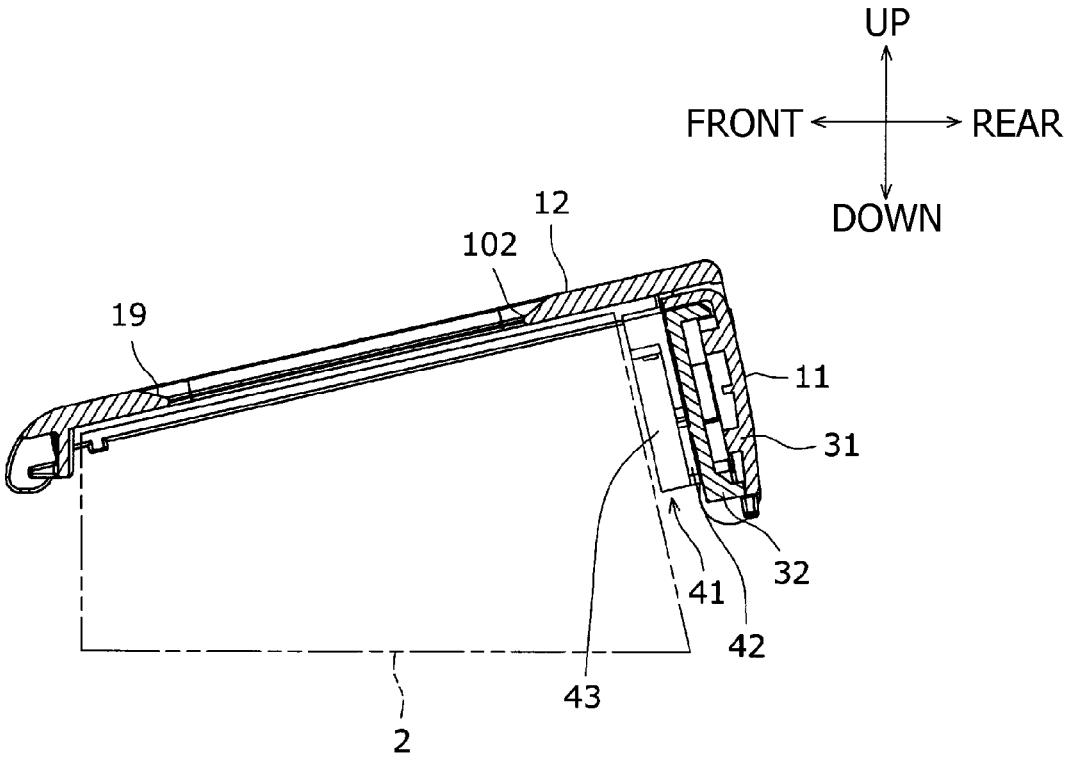

FIG. 13 is a cross-sectional side view of the first tray and the second tray taken along a cutting line (plane) B-B shown in FIG. 12 in the illustrative embodiment according to one or more aspects of the present disclosure.

Figure 14:
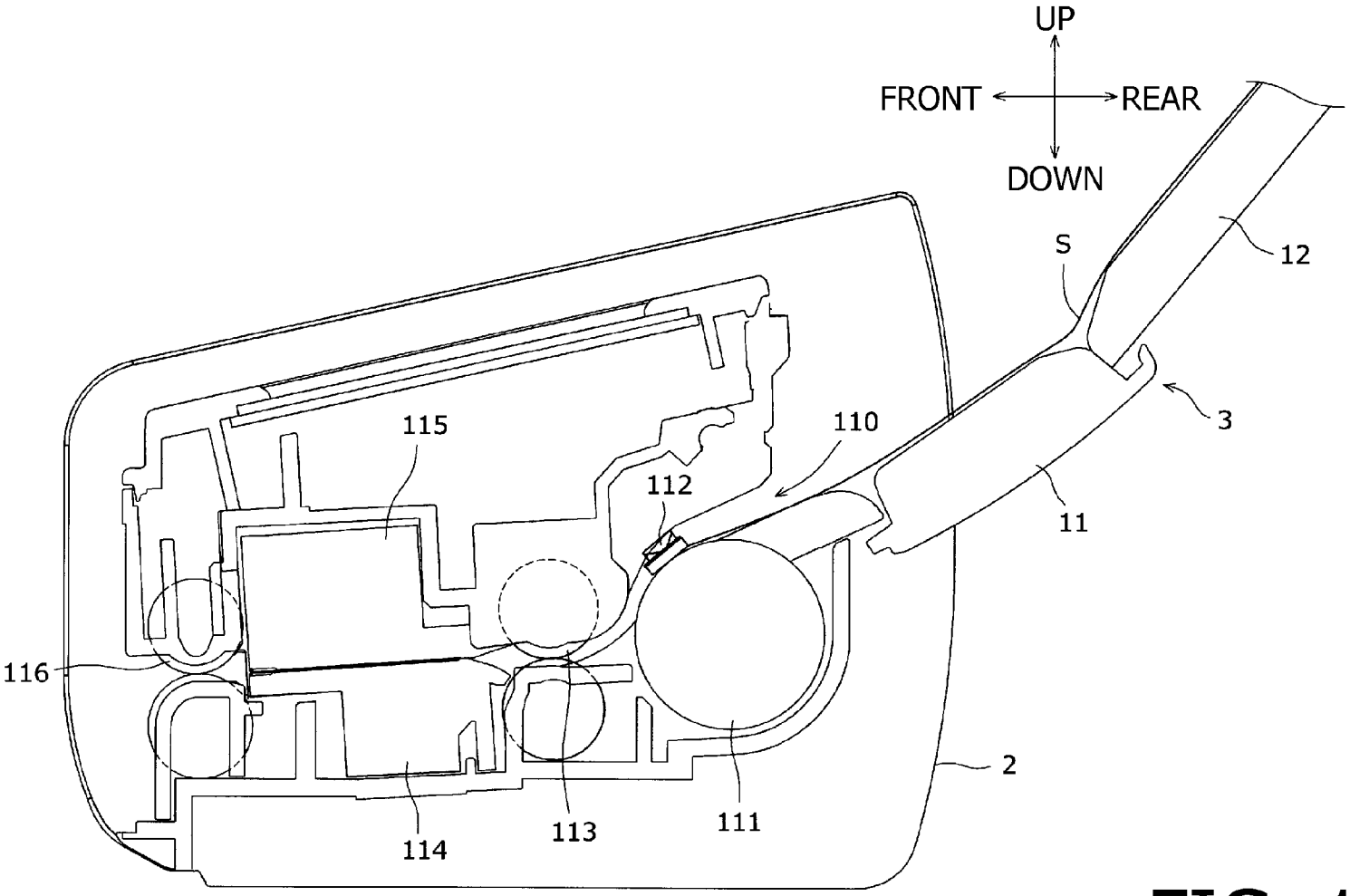

FIG. 14 is a cross-sectional side view schematically showing an internal configuration of the image reader in the illustrative embodiment according to one or more aspects of the present disclosure.

Figure 15:
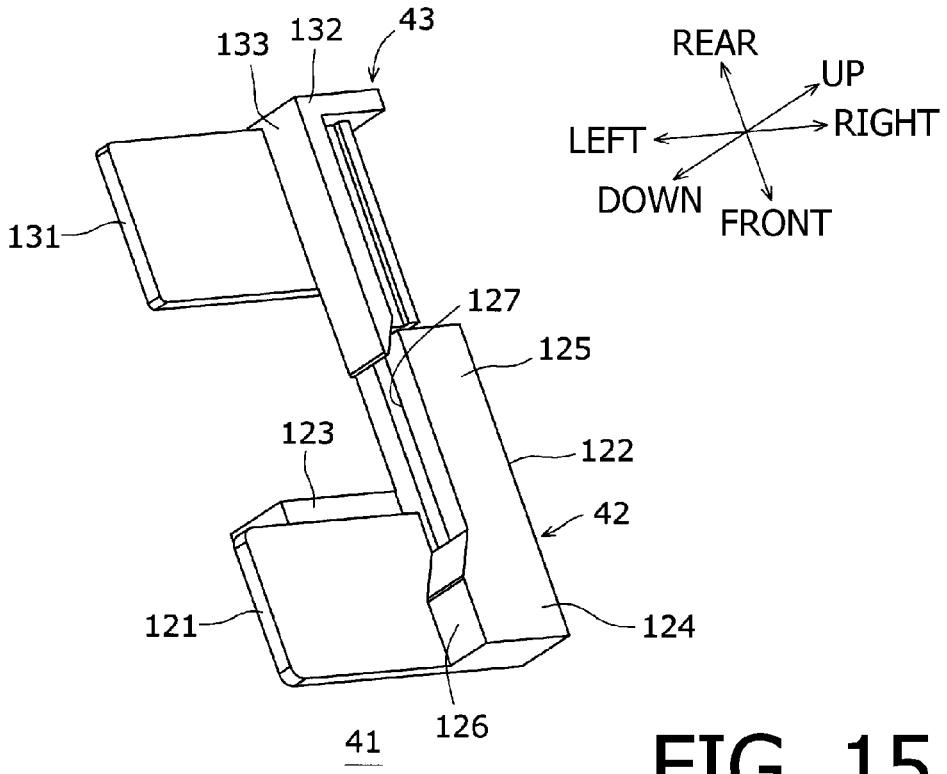

FIG. 15 is a perspective view showing a right one of width guides when a corresponding second guide is in a usage position, with a front-to-rear direction as a direction perpendicular to a rotational axis of a second tray and along a first tray surface of a first tray, in a modification according to one or more aspects of the present disclosure.

Figure 16:
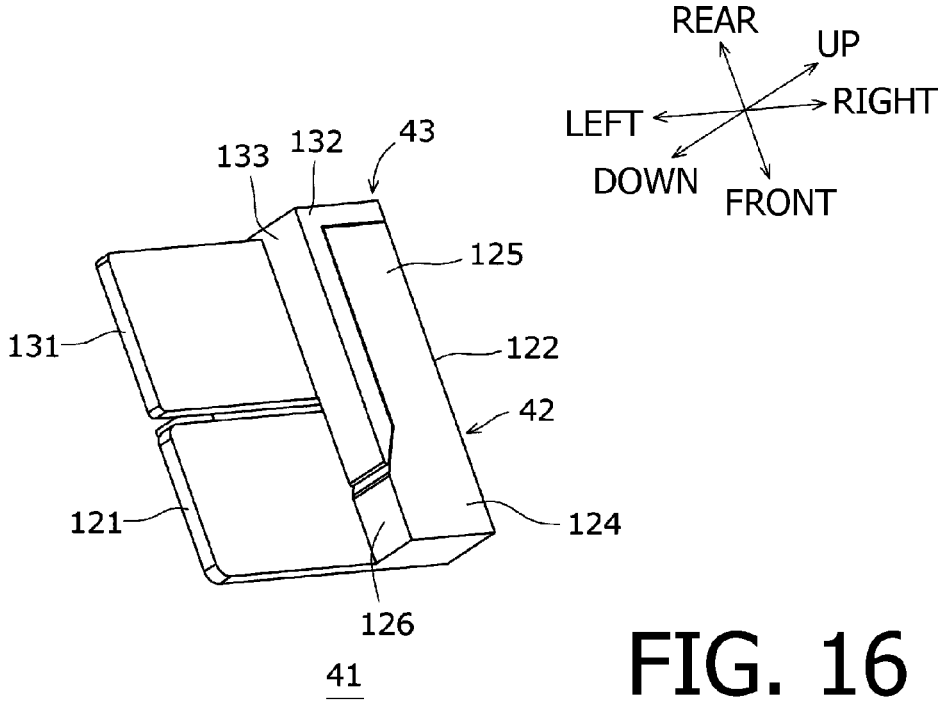

FIG. 16 is a perspective view showing the right width guide when the corresponding second guide is in a refracted position, with the front-to-rear direction as the direction perpendicular to the rotational axis of the second tray and along the first tray surface of the first tray, in the modification according to one or more aspects of the present disclosure.

Figure 17:
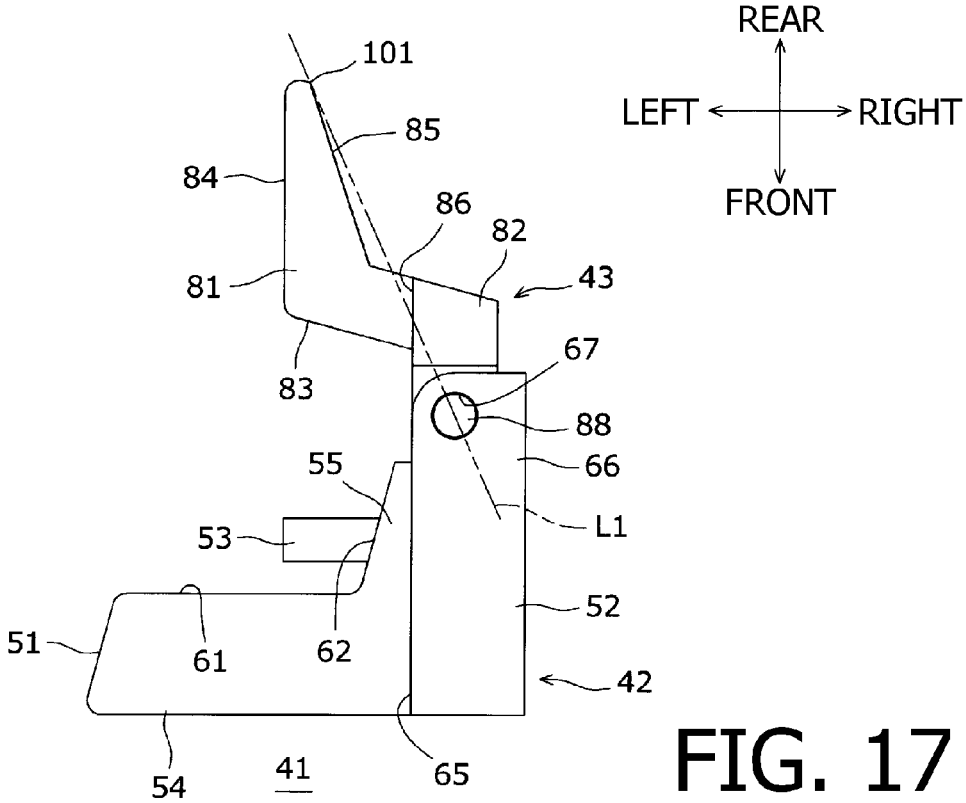

FIG. 17 is a top view showing a right one of width guides when a corresponding second guide is in a usage position, with the front-to-rear direction as the direction perpendicular to the rotational axis of the second tray and along the first tray surface of the first tray, in a different modification according to one or more aspects of the present disclosure.

Figure 18:
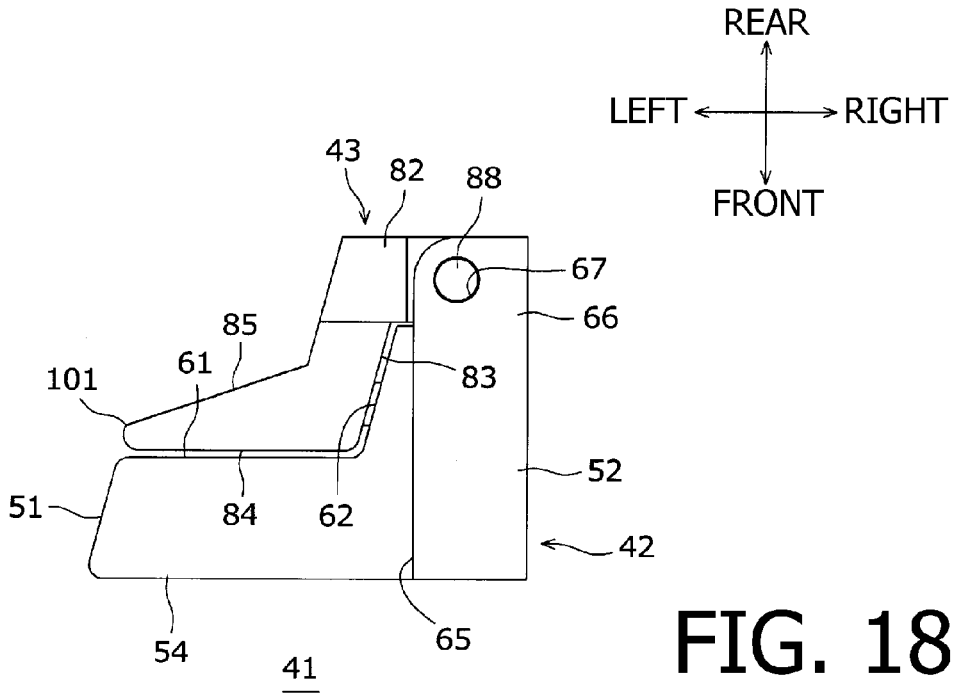

FIG. 18 is a top view showing the right width guide when the corresponding second guide is in a retracted position, with the front-to-rear direction as the direction perpendicular to the rotational axis of the second tray and along the first tray surface of the first tray, in the different modification according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an illustrative embodiment according to aspects of the present disclosure will be described with reference to the accompanying drawings.

<Overall Configuration>

Figure 1:
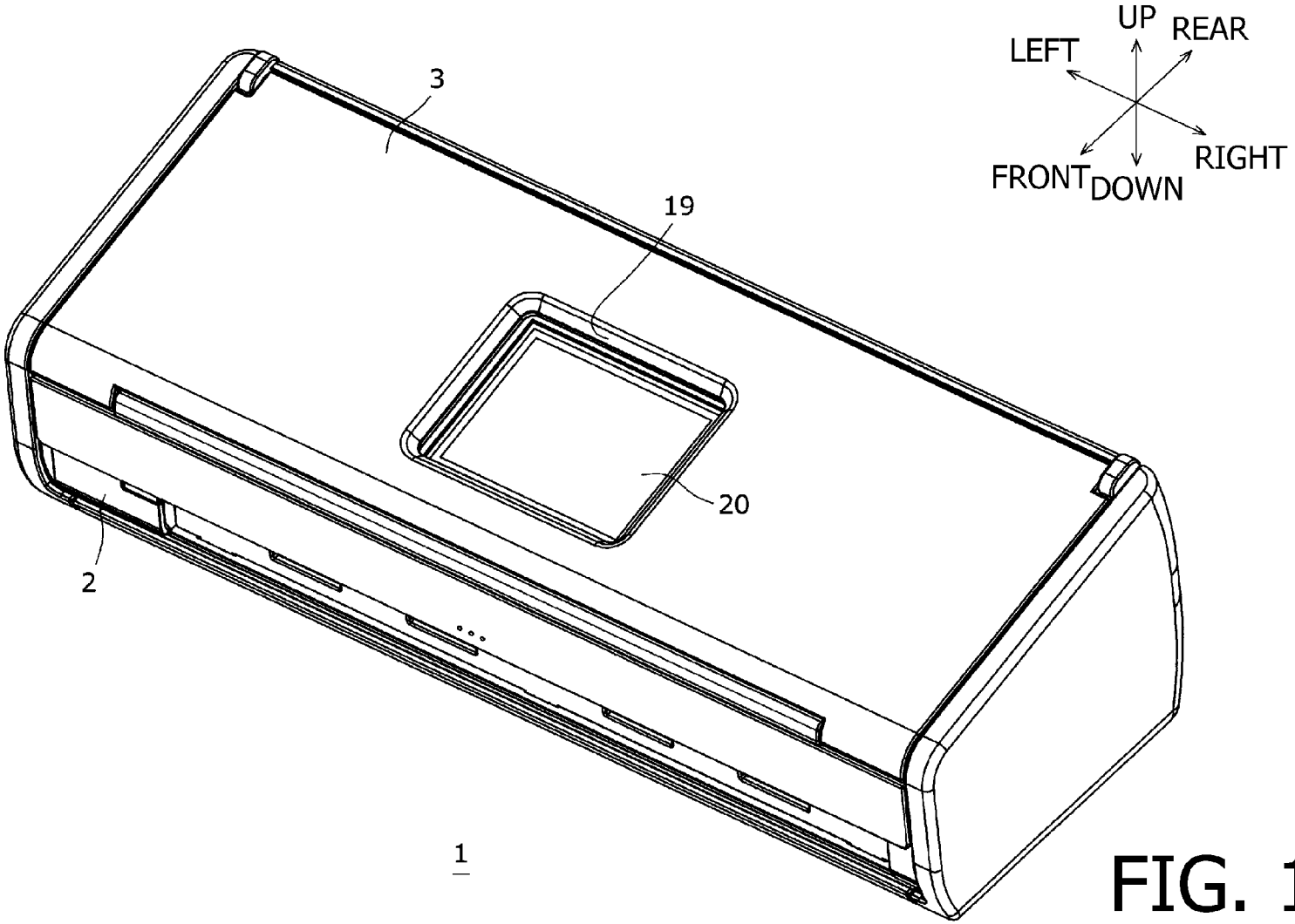
FIG. 1 is a perspective view of an image reader when a tray is in a closed position in an illustrative embodiment according to one or more aspects of the present disclosure.
Figure 2:
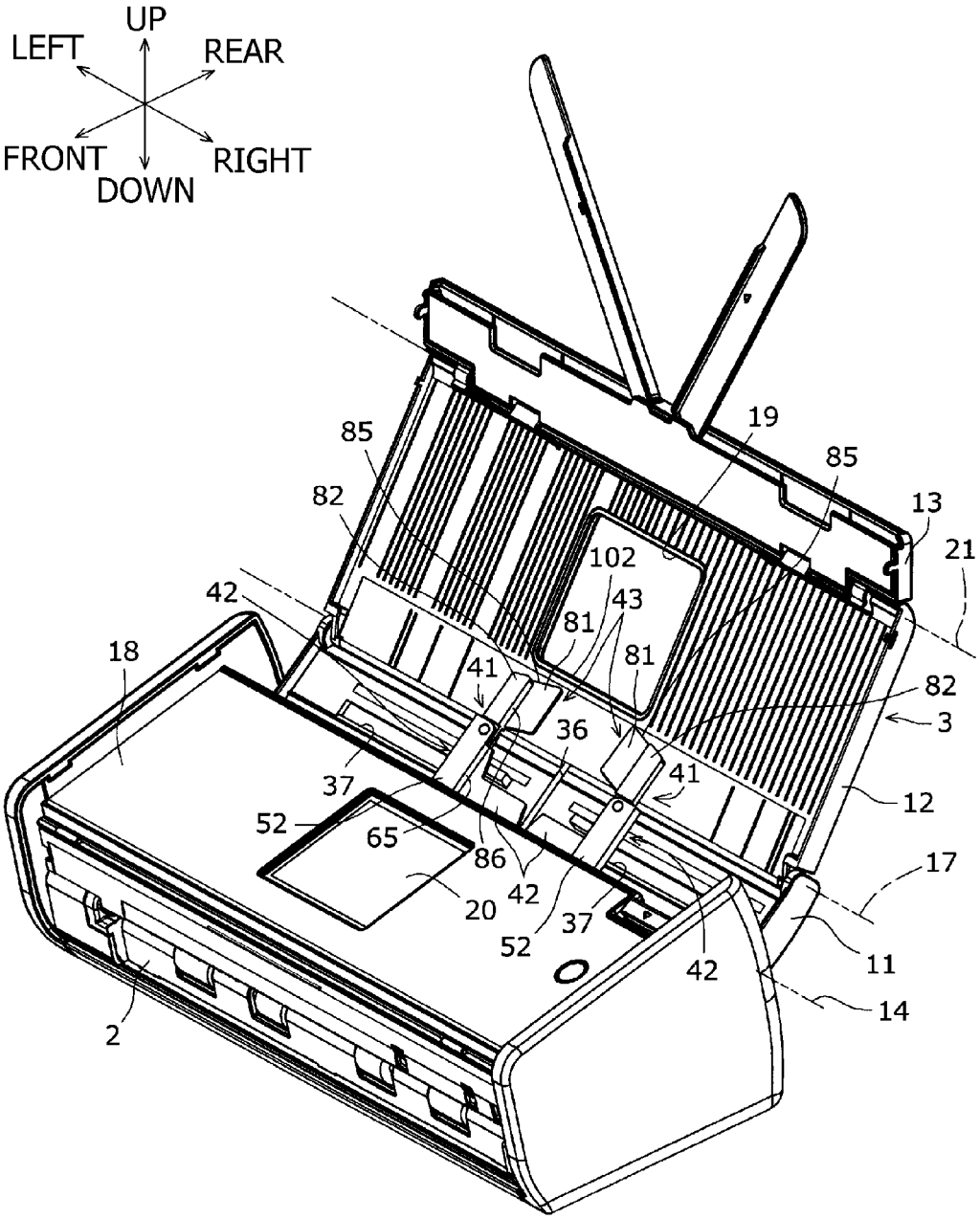
FIG. 2 is a perspective view of the image reader when the tray is in an open position in the illustrative embodiment according to one or more aspects of the present disclosure.

As shown in FIGS. 1 and 2, an image reader 1 is configured to read an image formed on a sheet S (see FIG. 14). The image reader 1 includes a housing 2 and a tray 3.

The tray 3 is configured to move between a closed position where the tray 3 is closed relative to the housing 2 and an open position where the tray 3 is open relative to the housing 2. In the open position, the tray 3 is allowed to support the sheet S placed thereon.

In FIGS. 1-3, 5-7, and 12-14, a side of the tray 3 in the open position with respect to the housing 2 is defined as a rear side of the image reader. Further, in FIGS. 1-3, 5-7, and 12-14, various directions are defined on the basis of the image reader 1 placed on a horizontal surface in a front view, and indicated by arrows in the drawings. The following description will be provided in accordance with the directions shown in the drawings.

The tray 3 includes a first tray 11, a second tray 12, and a third tray 13. The first tray 11 is disposed at the housing 2. The first tray 11 extends in a left-to-right direction. An end portion of the first tray 11 along a longitudinal direction (i.e., the left-to-right direction) of the first tray 11 is connected with a substantially middle portion of a rear end portion of the housing in a vertical direction in such a manner that the first tray 11 is rotatable around a rotational axis 14 extending in the left-to-right direction. Thereby, when the tray 3 is in the closed position, the first tray 11 is in a closed position where the first tray 11 extends toward an upper side of the rotational axis 14, along a rear surface of the housing 2 (see FIG. 1). Meanwhile, when the tray 3 is in the open position, the first tray 11 is in an open position where the first tray 11 is slanted toward a rear side of the housing 2, and extends obliquely toward an upper rear side from the housing 2 (see FIG. 2).

The second tray 12 is formed to be substantially as long as the first tray 11 in the left-to-right direction. The second tray 12 is rotatably supported by the first tray 11. For example, the second tray 12 includes shaft portions 15 (see FIG. 4) formed to respectively extend outward from both ends, in the left-to-right direction, of an end portion of the second tray 12 along the left-to-right direction. The first tray 11 includes bearing portions 16 (see FIG. 4) respectively formed at a left edge portion and a right edge portion of the first tray 11 on an opposite side of a side where the first tray 11 is connected with the housing 2. Each bearing portion 16 includes a round hole. Each shaft portion 15 is inserted into the corresponding bearing portion 16 from an inner side in the left-to-right direction, and rotatably supported by the corresponding bearing portion 16. Thereby, the second tray 12 is supported by the first tray 11 so as to be rotatable around a rotational axis 17 extending along a center axis common to the shaft portions 15. As shown in FIG. 4, the rotational axis 17 is positioned over a plane including a second tray surface 71 (see FIG. 3) of the second tray 12. Hereinafter, a conveyance direction of the sheet S along a first tray surface 35 of the first tray 11 in the open position, i.e., a direction that is perpendicular to the rotational axis 17 and along the first tray surface 35 will be defined as a first direction. Further, a conveyance direction of the sheet S along the second tray surface 71 of the second tray 12 when the tray 3 is in the open position, i.e., a direction that is perpendicular to the rotational axis 17 and along the second tray surface 71 will be defined as a second direction.

In FIG. 4, the first direction in which the first tray 11 extends corresponds to a front-to-rear direction. A side where the second tray 12 is positioned when the tray 3 is in the open position corresponds to a rear side of the image reader 1. A direction perpendicular to the first tray surface 35 when the tray 3 is in the open position corresponds to the vertical direction. A side toward which the first tray surface 35 faces when the tray 3 is in the open position corresponds to an upside of the image reader 1.

As shown in FIG. 1, when the tray 3 is in the closed position, the second tray 12 is in a closed position where the second tray 12 is bent relative to the first tray 11, and covers an upper surface 18 of the housing 2. Meanwhile, when the tray 3 is in the open position, the second tray 12 is in an open position where the second tray 12 is open rearward relative to the first tray 11, and extends obliquely toward an upper rear side from the first tray 11 (see FIG. 2). In the closed position, the second tray 12 is closed relative to the first tray surface 35. Further, in the open position, the second tray 12 is open relative to the first tray surface 35. Namely, an angle between the first tray surface 35 and the second tray surface 71 when the second tray 12 is in the open position is greater than an angle between the first tray surface 35 and the second tray surface 71 when the second tray 12 is in the closed position. For example, in the illustrative embodiment, when the second tray 12 is in the open position, the angle between the first tray surface 35 and the second tray surface 71 is more than 90 degrees and equal to or less than 180 degrees. Further, for example, when the second tray 12 is in the closed position, the angle between the first tray surface 35 and the second tray surface 71 is less than 90 degrees.

At a middle portion of the second tray 12, there is an opening 19 formed to penetrate the second tray 12. The opening 19 is configured to expose therethrough an operation panel 20 disposed on the upper surface 18 of the housing 2, when the tray is in the closed position. Owing to the opening 19, a user is allowed to access the operation panel 20 regardless of whether the tray 3 is in the closed position or the open position.

The third tray 13 is formed to be substantially as long as the first tray 11 and the second tray 12 in the left-to-right direction. The third tray 13 is connected with an end portion of the second tray 12 on an opposite side of a side close to the first tray 11, so as to be rotatable around a rotational axis 21 extending in the left-to-right direction. Thereby, when the tray 3 is in the closed position, the third tray 13 is in a closed position where the third tray 13 is bent downward relative to the second tray 12 and extends along a front surface of the housing 2 (see FIG. 1). Meanwhile, when the tray 3 is in the open position, the third tray 13 is in an open position where the third tray 13 is open rearward relative to the second tray 12 and extends obliquely toward an upper rear side from the second tray 12 (see FIG. 2).

Figure 3:
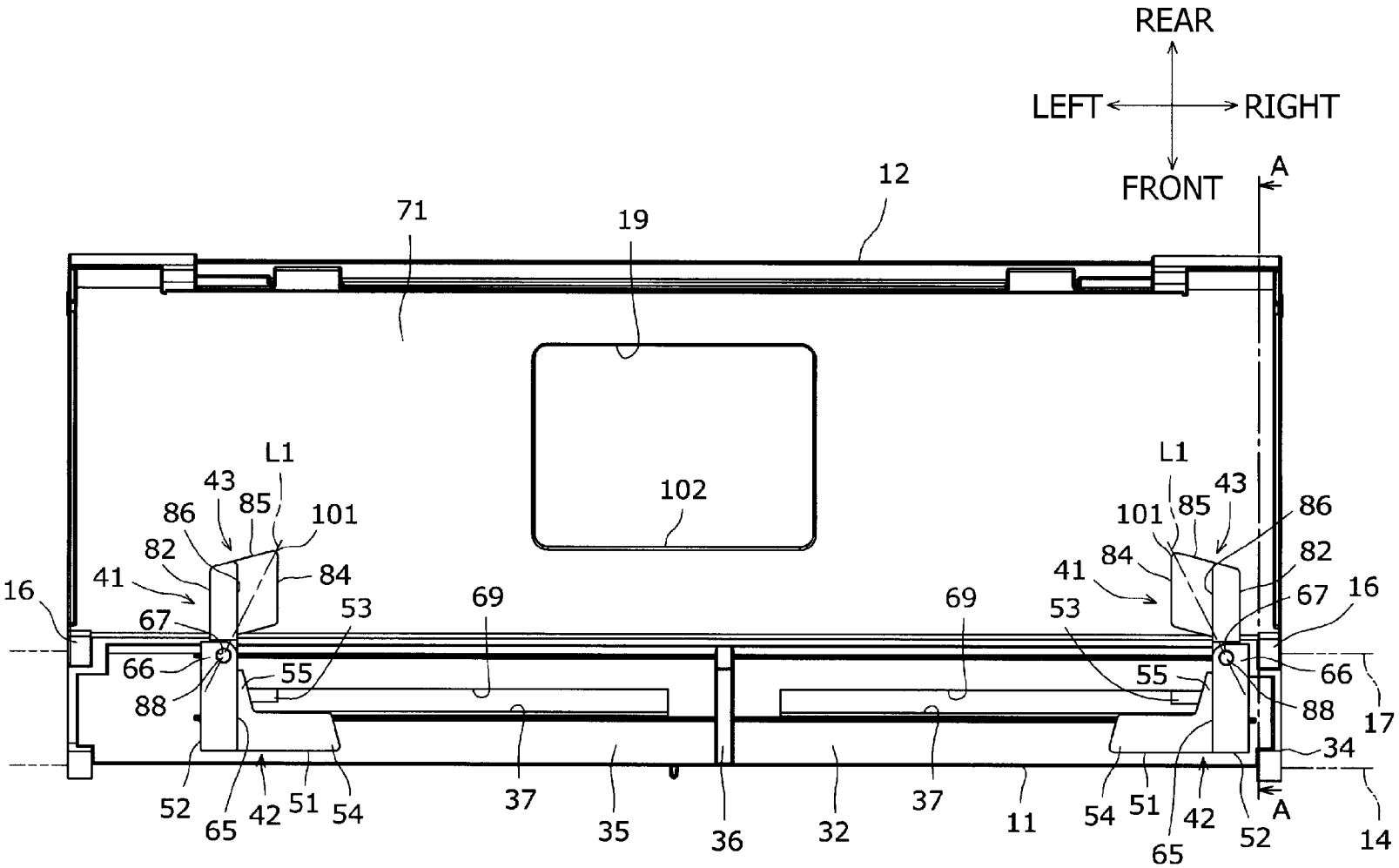
FIG. 3 is a top view showing a first tray and a second tray when second guides are in their respective usage positions in the illustrative embodiment according to one or more aspects of the present disclosure.
Figure 4:
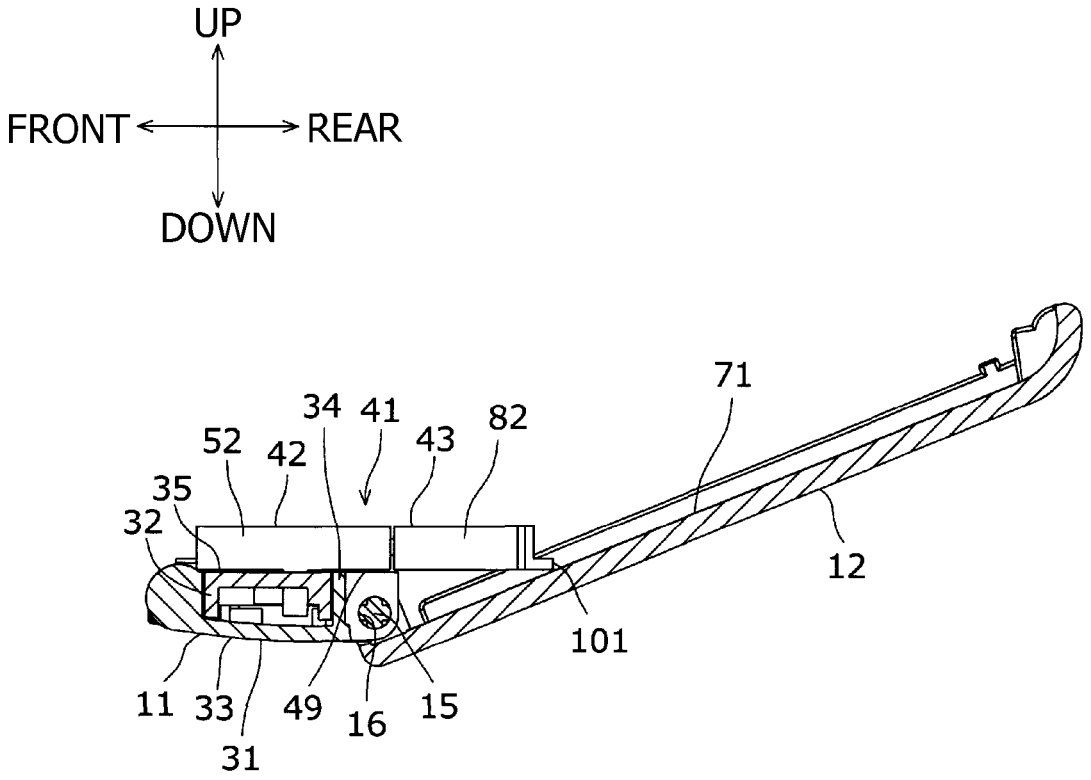
FIG. 4 is a cross-sectional side view taken along a cutting line (plane) A-A shown in FIG. 3, showing the first tray and the second tray with a front-to-rear direction as a direction perpendicular to a rotational axis of the second tray and along a first tray surface of the first tray, in the illustrative embodiment according to one or more aspects of the present disclosure.

As shown in FIGS. 3 and 4, the first tray 11 includes an outer member 31 and an inner member 32. The outer member 31 is provided integrally with a plate-shaped portion 33 and a wall portion 34. The plate-shaped portion 33 extends in the left-to-right direction. The wall portion 34 rises from both end portions of the plate-shaped portion 33 in the left-to-right direction and from an end portion of the plate-shaped portion 33 on a side close to the second tray 12. The inner member 32 is disposed apart from the plate-shaped portion 33, in a region surrounded by the wall portion 34 of the outer member 31.

A surface of the inner member 32 on a side opposite to a side close to the outer member 31 is the first tray surface 35 configured to support the sheet S placed thereon. When the tray 3 is in the closed position, the first tray surface 35 faces the rear surface of the housing 2 from the rear side. When the tray 3 is in the open position, the first tray surface 35 faces toward an upper front side.

As shown in FIGS. 3, 5, 6, and 7, the first tray surface 35 includes a projection 36 formed on a right side of a center of the first tray surface 35 in the left-to-right direction. The projection 36 protrudes in a direction perpendicular to the first tray surface 35, from the first tray surface 35. The projection 36 extends over a whole length of the first tray surface 35 in the front-to-rear direction. An upper surface of the projection 36 is parallel to the first tray surface 35.

Further, the inner member 32 includes guide openings 37 formed to penetrate the inner member 32 in a direction perpendicular to the first tray surface 35. The guide openings 37 are disposed on both sides of the projection 36 in the left-to-right direction. Each guide opening 37 linearly extends in the left-to-right direction.

Above each guide opening 37, disposed is a width guide 41 configured to move along the guide opening 37. The width guides 41 are configured to be mirror-symmetric with respect to a plane perpendicular to the left-to-right direction. Hereinafter, an explanation will be provided about a right one of the width guides 41.

As shown in FIGS. 8 to 11, the (right) width guide 41 includes a first guide 42 and a second guide 43. The first guide 42 is provided integrally with a first placement portion 51, a first regulation portion 52, and an insertion portion 53. It is noted that FIGS. 8 to 11 are depicted with a front-to-rear direction as the first direction that is perpendicular to the rotational axis 17 and along the first tray surface 35. Further, FIGS. 8 to 11 are depicted with a rear side as a side of the second tray 12 in the open position, a vertical direction as a direction perpendicular to the first tray surface 35, and an upside as a side toward which the first tray surface 35 faces.

The first placement portion 51 is formed in a plate shape. The first placement portion 51 includes a main body section 54 extending in the left-to-right direction, and an extension 55 extending rearward from a right end portion of the main body section 54. The main body section 54 and the extension 55 are integrally formed. As shown in FIGS. 10 and 11, a groove 56 is formed at a rear end portion of the extension 55. The groove 56 is open rearward and downward. The extension 55, which includes the groove 56, has a first surface 57, a second surface 58, a third surface 59, and a fourth surface 60. The first surface 57 is formed to be a flat surface linearly extending forward from a rear end portion of the first placement portion 51. The second surface 58 is formed to be a flat surface linearly extending leftward from a front end portion of the first surface 57. The third surface 59 is formed to be a flat surface extending rearward from a left end portion of the second surface 58 in a manner parallel to the first surface 57. The third surface 59 is substantially half as long as the first surface 57 in the front-to-rear direction. The fourth surface 60 is formed to be an arc surface that bulges leftward from a rear end portion of the third surface 59 and extends rearward. Further, the extension 55 has a left end face 62 that extends slanted toward a rear right side with respect to a rear end face 61 of the main body section 54. Further, inside the groove 56, there is a cylindrical portion 63 formed to protrude downward. At the rear end portion of the extension 55, there is a shaft insertion hole 64 formed to penetrate in the vertical direction.

As shown in FIGS. 8 and 9, the first regulation portion rises upward from a right end portion of the first placement portion 51 and extends in the front-to-rear direction. A first guide surface 65 as a left end face of the first regulation portion 52 is formed to be a flat surface that is perpendicular to an upper surface of the first placement portion 51 and extends in the front-to-rear direction. A rear end portion 66 of the first regulation portion 52 is formed to be thinner than the other portion of the first regulation portion 52, and is spaced apart from a rear end portion of the extension 55 of the first placement portion 51. The rear end portion 66 includes a shaft insertion hole 674 disposed to overlap the shaft insertion hole 64 of the first placement portion 51 substantially in the vertical direction. The shaft insertion hole 67 is formed to be a round hole that penetrates in the vertical direction and has an inside diameter substantially identical to an inside diameter of the shaft insertion hole 64.

As shown in FIGS. 10 and 11, the insertion portion 53 protrudes relative to a lower surface of the first placement portion 51 and extends in the left-to-right direction. The insertion portion 53 is inserted into the guide opening 37, and then a rear end face 68 of the insertion portion 53 comes into contact with a rear end portion of the guide opening 37 from the front.

As shown in FIGS. 3, 5, 6, and 7, the second guide 43 is configured to move between a retracted position and a usage position. In the retracted position, the second guide 43 is straight above the first tray surface 35 of the first tray 11 (i.e., the second guide 43 faces the first tray surface 35 in a direction substantially perpendicular to the first tray surface 35). In the usage position, the second guide 43 is straight above the second tray surface 71 of the second tray 12 (i.e., the second guide 43 faces the second tray surface 71 in a direction substantially perpendicular to the second tray surface 71). When the tray 3 is in the closed position, the second tray surface 71 faces the upper surface 18 of the housing 2 from above. Further, when the tray 3 is in the open position, the second tray surface 71 faces toward an upper front side to be able to support the sheet S placed thereon. The second guide 43 is provided integrally with a second placement portion 81 and a second regulation portion 82.

The second placement portion 81 is formed in a plate shape. As shown in FIGS. 8 and 9, the second placement portion 81 includes a first end face 83, a second end face 84, and a third end face 85. As shown in FIG. 9, the first end face 83 is formed to be a flat surface that extends parallel to the left end face 62 of the first placement portion 51 of the first guide 42 when the second guide 43 is in the retracted position. The second end face 84 is formed to be a flat surface that extends rightward from a lower end portion of the first end face 83 in a manner parallel to the rear end face 61 of the first placement portion 51 of the first guide 42 when the second guide 43 is in the retracted position. The third end face 85 is formed to be a flat surface that extends from a left end portion of the second end face 84 in a manner parallel to the first end face 83 when the second guide 43 is in the retracted position.

Further, as shown in FIGS. 10 and 11, on a lower surface of the second placement portion 81, there is a linear groove 80 formed to be open toward the first guide 42 when the second guide 43 is in the usage position.

As shown in FIGS. 8 and 9, the second regulation portion 82 rises upward from the second placement portion 81. An upper surface of the second regulation portion 82 is disposed lower than an upper surface of the first regulation portion 52 of the first guide 42 in a direction perpendicular to the first tray surface 35. As shown in FIG. 9, when the second guide 43 is in the retracted position, the second regulation portion 82 extends in the left-to-right direction at a rear end portion of the second guide 43. Further, as shown in FIG. 8, when the second guide 43 is in the usage position, the second regulation portion 82 extends in the front-to-rear direction at a right end portion of the second guide 43. The second regulation portion 82 includes a second guide surface 86 that is disposed in a plane including the first guide surface 65 of the first guide 42 when the second guide 43 is in the usage position.

Further, the second regulation portion 82 is provided integrally with an extension 87 that extends toward the first guide 42 from an end portion of the second regulation portion 82 on a side close to the first guide 42. The extension 87 includes an upper shaft portion 88 formed to protrude upward, and a cylindrical portion 63 formed to protrude downward. The extension 87 is inserted between the extension 55 of the first guide 42 and the rear end portion 66 of the first regulation portion 52. The upper shaft portion 88 is inserted into the shaft insertion hole 67. The cylindrical portion 63 is inserted into the shaft insertion hole 64. Thereby, the second guide 43 is configured to rotate relative to the first guide 42, on the upper shaft portion 88 and the cylindrical portion 63 as pivots. The second guide 43 is made of resin and lighter than the second tray 12.

Further, as shown in FIGS. 10 and 11, the width guide 41 includes a torsion spring 91. A coil portion 92 of the torsion spring 91 is fitted around the cylindrical portion 63. An arm portion 93 of the torsion spring 91 is disposed between the first surface 57 and the third surface 59 of the groove 56 of the first guide 42. Another arm portion 94 of the torsion spring 91 is disposed in the groove 80 formed at the second guide 43. When the second guide 43 is in the retracted position, the torsion spring 91 is more twisted than when the second guide 43 is in the usage position. Therefore, by the torsion spring 91, the second guide 43 is urged in a direction from the retracted position toward the usage position. In other words, by the torsion spring 91, the second guide 43 is urged in such a direction as to rotate from a left side of the torsion spring 91 (see FIG. 11) toward a rear side of the torsion spring 91 (see FIG. 10).

When the tray 3 is in the open position, as shown in FIGS. 3 and 6, the second guide 43 is held in the usage position by the urging force of the torsion spring 91. When the second guide 43 is in the usage position, an edge portion formed between the second end face 84 and the third end face 85 of the second guide 43 is a distal end portion 101 that is the farthest away from a center axis common to the upper shaft portion 88 and the cylindrical portion 63 as a rotational axis of the second guide 43 (than any other portion of the second guide 43). The distal end portion 101 of the (right) second guide 43 is positioned on a left side of the center axis of the upper shaft portion 88 and the cylindrical portion 63, and contacts the second tray surface 71 of the second tray 12. Further, the third end face 85 of the (right) second guide 43 is positioned on a right side of a straight line L1 that connects the distal end portion 101 and the center axis of the upper shaft portion 88 and the cylindrical portion 63. Further, as shown in FIG. 6, the distal end portion 101 is in front of a front end portion 102 of the opening 19 of the second tray 12.

In a state where the tray 3 is in the open position, and the second guide 43 is in the usage position, when the tray 3 is moved toward the closed position, the distal end portion 101 of the second guide 43 is pushed forward by the second tray surface 71 of the second tray 12. As described above, the distal end portion of the (right) second guide 43 is positioned on the left side of the center axis of the upper shaft portion 88 and the cylindrical portion 63. Therefore, when the distal end portion 101 is pushed by the second tray surface 71, the second guide 43 is rotated leftward on the upper shaft portion 88 and the cylindrical portion 63 as pivots. As the tray 3 becomes closer to the closed position, the second guide 43 becomes closer to the refracted position. Then, the second tray surface 71 comes into contact with the third end face 85 of the second guide 43. Thereafter, when the tray 3 is further moved toward the closed position, the second tray surface 71 comes into contact with a distal end portion of the second regulation portion 82 of the second guide 43, and pushes the distal end portion of the second regulation portion 82 forward. Thereby, the second guide 43 is further rotated. Then, when the tray 3 is placed in the closed position, as shown in FIG. 12, the second guide 43 is placed in the retracted position in a state where a rear left end portion of the second regulation portion 82 shown in FIG. 9 is in contact with the second tray surface 71. Further, as shown in FIG. 13, the width guide 41 is housed between the housing 2 and the first tray 11.

In a state where the tray 3 is in the closed position, and the second guide 43 is in the retracted position, the distal end portion of the second regulation portion 82 of the second guide 43 is brought into contact with the second tray surface 71 by the urging force of the torsion spring 91. Therefore, when the tray 3 is moved from the closed position toward the open position, as the second tray 12 is more widely opened relative to the first tray 11, the second guide 43 is further moved from the retracted position toward the usage position by the urging force of the torsion spring 91. Then, as shown in FIGS. 3 and 6, when the tray 3 is placed in the open position, the second guide 43 is placed in the usage position.

Further, between the outer member 31 and the inner member 32 of the first tray 11, an interlocking mechanism (not shown) is disposed. The interlocking mechanism is configured to move the two width guides 41 (the left width guide 41 and the right width guide 41) in conjunction with each other. By the interlocking mechanism, the two width guides 41 are moved by the same displacement in mutually-opposite directions with respect to the projection 36 as a center reference, respectively. As shown in FIG. 7, when the two width guides 41 are moved to respective positions closest to each other, the first placement portion 51 of the first guide 42 of each width guide 41 comes into contact with the projection 36. Thereby, a minimum distance L2 between the center axes of the two upper shaft portions 88 (the left and right upper shaft portions 88) is determined. The minimum distance L2 is set longer than a length that is twice as long as a length L3, in a longitudinal direction, of the second regulation portion 82 of each second guide 43. In other words, in a state where the two first guides 42 (the left and right first guides 42) are closest to each other, and each second guide 43 is in the retracted position straight above the first tray surface 35, a sum of the lengths L3 of the two second guides 43 in the left-to-right direction is less than the distance L2 between the center axes of the upper shaft portions 88. Thereby, the two second guides 43 are allowed to be in the respective retracted positions without vertically overlapping.

The positions of the two width guides 41 are adjusted to meet a width, in the left-to-right direction, of the sheet S to be read by the image reader 1. Then, the sheet S is inserted between the first guide surfaces 65 of the two first guides 42 and between the second guide surfaces 86 of the two second guides 43. Further, the sheet S is placed on the first placement portions 51 of the two first guides 42 and the second placement portions 81 of the second guides 43. The sheet S contacts an upper surface of the projection 36. Two end portions of the sheet S in the left-to-right direction are supported by the first placement portions 51 and the second placement portions 81. A middle portion of the sheet S in the left-to-right direction is supported by the projections 36. Thereafter, when an instruction to start reading the image of the sheet S is issued, the sheet S is drawn into the housing 2 via a sheet feeding port 110 formed at the housing 2. The sheet feeding port 110 is disposed on an opposite side of the second tray 12 in the open position with respect to the first tray 11 in the open position. The sheet feeding port 110 is open in the first direction.

As shown in FIG. 14, inside the housing 2, disposed are a pickup roller 111, a separation pad 112, two feed rollers 113, a first reading unit 114, a second reading unit 115, and two ejection rollers 116. For example, each of the first reading unit 114 and the second reading unit 115 may be provided with a CIS ("CIS" is an abbreviation for "contact image sensor").

When the instruction to start reading the image of the sheet S is issued, the pickup roller 111, the two feed rollers 113, and the two ejection rollers 116 begin to rotate. When the pickup roller 111 is rotated, a feeding force is applied to sheets S by the pickup roller 111, and leading ends of the sheets S are conveyed to a position between pickup roller 111 and the separation pad 112. When the sheets S are pinched between the pickup roller 111 and the separation pad 112, the sheets S are separated and fed forward on a sheet-by-sheet basis. Thereby, a single sheet S passes between the pickup roller 111 and the separation pad 112.

Thereafter, the sheet S reaches a position between the two feed rollers 113, and is further conveyed forward by a feeding force applied to the sheet S by the feed rollers 113. Then, while the sheet S is passing between the first reading unit 114 and the second reading unit 115, one or more images formed on a lower side and/or an upper side of the sheet S are read by the first reading unit 114 and/or the second reading unit 115.

When further conveyed and reaching a position between the two ejection rollers 116, the sheet S is ejected to an outside of the housing 2 by a feeding force applied to the sheet S by the ejection rollers 116.

<Operations and Advantageous Effects>

As described above, the image reader 1 includes the first tray 11 and the second tray 12. The first tray 11 is disposed at the housing 2 that contains therein the first reading unit 114 and the second reading unit 115. The second tray 12 is rotatably supported by the first tray 11. The first tray 11 and the second tray 12 have the first tray surface 35 and the second tray surface 71, respectively. The first guides 42 are disposed on the first tray surface 35. Each first guide 42 is connected with the corresponding second guide 43 configured to move between the retracted position straight above the first tray surface 35 (i.e., the retracted position where the second guide 43 faces the first tray surface 35 in the direction substantially perpendicular to the first tray surface 35) and the usage position straight above the second tray surface 71 (i.e., the usage position where the second guide 43 faces the second tray surface 71 in the direction substantially perpendicular to the second tray surface 71).

Each first guide 42 extends in the front-to-rear direction that is the first direction perpendicular to the rotational axis 17 of the second tray 12 and parallel to the first tray surface 35. Further, each second guide 43 connected with the corresponding first guide 42 is positioned straight above the second tray surface 71. Thus, each width guide 41, including the corresponding first guide 42 and the corresponding second guide 43, extends in its longitudinal direction along the front-to-rear direction so as to straddle both the first tray surface 35 and the second tray surface 71. Therefore, it is possible to place the sheet S on the first tray surface 35 and the second tray surface 71 in a state where side edges of the sheet S in the left-to-right direction are along the width guides 41 extending in their longitudinal direction along the front-to-rear direction, respectively. Accordingly, it is possible to improve a function to guide the sheet S along the front-to-rear direction. Consequently, it is possible to prevent the sheet S from being fed obliquely with a skew angle.

Each first guide 42 is disposed on the first tray surface 35, and extends in the front-to-rear direction. The housing 2 includes the sheet feeding port 110 formed on an opposite side of the second tray 12 with respect to the first tray 11. The sheet feeding port 110 is open in the front-to-rear direction. Therefore, the first guides 42 are positioned close to the sheet feeding port 110. Accordingly, near the sheet feeding port 110, it is possible to guide the sheet S along the front-to-rear direction with the first guides 42. Consequently, it is possible to further prevent the sheet S from being fed obliquely with a skew angle.

Each second guide 43 is configured to rotate around the rotational axis thereof (i.e., the center axis of the corresponding upper shaft portion 88 and the corresponding cylindrical portion 63) that extends in a direction intersecting the first tray surface 35. Further, each second guide 43 is configured to move between the retracted position straight above the first tray surface 35 and the usage position straight above the second tray surface 71. Thereby, it is possible to arrange the second guides 43 in the left-to-right direction relative to the first guide 42, over the first tray surface 35. Accordingly, it is possible to prevent the second guides 43 from overlapping the first guides 42 in a direction along the rotational axes of the second guides 43 (i.e., substantially in the vertical direction), when the second guides 43 are in the respective retracted positions straight above the first tray surface 35. Thus, it is possible to downsize the image reader 1 in the vertical direction.

The first guides 42 are disposed at one side and the other side in the left-to-right direction, respectively. The second guides 43 are provided in correspondence with the first guides 42, respectively. Further, each second guide 43 is configured to move between the retracted position straight above the first tray surface 32 and the usage position straight above the second tray surface 71, by rotating around the rotational axis substantially perpendicular to the first tray surface 35 between the left-to-right direction toward the other second guide 73 and the first direction. In other words, each second guide 43 is configured to rotate around the rotational axis substantially perpendicular to the first tray surface 35, between the retracted position where the second guides 43 extend toward each other from the respective rotational axes thereof along the left-to-right direction over the first tray surface 35, and the usage position where each second guide 43 extends from the rotational axis thereof along the first direction over the second tray surface 71. Thereby, from the usage position, each second guide 43 is rotatable in a direction (leftward or rightward) toward the other second guide 43. Thus, it is possible to attain a smaller size of the image reader 1 in the left-to-right direction than when each second guide 43 is configured to move (rotate) in a direction opposite to the direction toward the other second guide 43.

Each first guide 42 is configured to move along the left-to-right direction. Each second guide 43 is configured to satisfy the following requirement in a state where the first guides 43 are closest to each other, and the second guides 43 are in the respective retracted positions. The requirement is that the sum of the lengths L3 of the second guides 43 in the left-to-right direction is less than the distance L2 between the center axes of the upper shaft portions 88 (i.e., the left upper shaft portion 88 and the right upper shaft portion 88). Thereby, when the first guides 42 are closest to each other in the left-to-right direction, it is possible to arrange the second guides 43 side by side along the left-to-right direction, between the first guides 42. Therefore, it is possible to prevent the second guides 43 from overlapping each other in the front-to-rear direction over the first tray surface 35. Thus, it is possible to downsize the image reader 1 in the front-to-rear direction.

The second guides 43 have a height less than a height of the first guides 42 in the direction along the rotational axes of the second guides 43. Therefore, over the first tray surface 35, the second guides 43 do not protrude higher than the first guides 42 in the direction along the rotational axes of the second guides 43. Accordingly, in order to dispose the second guides 43 straight above the first tray surface 35, it is not required to enlarge a space over the first tray surface 35 in the direction along the rotational axes of the second guides 43.

The second tray 12 is configured to move between the open position where the second tray 12 is open relative to the first tray surface 35 and the closed position where the second tray 12 is closed relative to the first tray surface 35. When the second tray 12 is in the open position, each second guide 43 is rotatable between the retracted position straight above the first tray surface 35 and the usage position straight above the second tray surface 71. In the retracted position, each second guide 43 is placed to extend toward the other second guide 43 along the left-to-right direction over the first tray surface 35. Thereby, when the second tray 12 is in the closed position, and the second guides 43 are in the respective retracted positions, none of the second guides 43 is positioned between the second tray 12 and the housing 2. Therefore, it is possible to put the second tray 12 close to the housing 2. Thus, it is possible to downsize the image reader 1.

Each second guide 43 is formed in such a shape that when the second guide 43 is in the usage position, the distal end portion 101 thereof, which is farthest away from the rotational axis of the second guide 43 in the front-to-rear direction (the first direction), is disposed on an inner side of the rotational axis of the second guide 43 in the left-to-right direction. Therefore, when the second tray 12 is moved from the open position to the closed position in a state where the second guide 43 is staying in the usage position, the second tray 12 comes into contact with the distal end portion 101 of the second guide 43, and a pressing force from the second tray 12 is applied to the distal end portion 101 of the second guide 43. As described above, the distal end portion of the second guide 43 is positioned on the inner side of the rotational axis of the second guide 43 in the left-to-right direction. Therefore, the pressing force is converted into a force for rotating the second guide 43. Consequently, it is possible to move the second tray 12 from the open position to the closed position, and concurrently move the second guide 43 from the usage position toward the retracted position.

Further, each second guide 43 includes a third end face 85 that extends from the distal end portion 101 to slant toward the rotational axis of the second guide 43 with respect to the left-to-right direction, when the second guide 43 is in the usage position. When the second tray 12 is moved from the open position toward the closed position, the second tray 12 comes into contact with the distal end portion 101 of the second guide 43. Thereafter, in response to a further movement of the second tray 12, the second tray 12 comes into contact with the third end face 85, so as to enlarge a contact area between the second tray 12 and the second guide 43. Hence, while the second tray 12 is in contact with the third end face 85, a pressing force from the second tray 12 is applied to the second guide 43. Consequently, in response to the movement of the second tray 12, the second guide 43 is allowed to move from the usage position to the retracted position.

When each second guide 43 is in the usage position, the third end face 85 is positioned on an outer side, in the left-to-right direction, of the straight line L1 connecting the rotational axis of the second guide 43 with the distal end portion 101. It is possible to secure a long distance in the front-to-rear direction (the first direction) between an outer end portion of the third end face 85 in the left-to-right direction and the rotational axis of the second guide 43. Therefore, in the second guide 43, it is possible to secure a desired length of the second guide surface 86 that contacts a side edge of the sheet S in the left-to-right direction. Consequently, it is possible to further improve a sheet guiding function of the second guide 43.

When the second tray 12 is in the open position, the rotational axis 17 of the second tray 12 is positioned over the plane including the second tray surface 71.

A direction of the force, to be applied by the second tray 12 to the distal end portion 101 of each second guide 43 when the second tray 12 is moved from the open position to the closed position, is slanted with respect to the first tray surface 35. When the rotational axis 17 of the second tray 12 is positioned on a side close to the second guides 43 with respect to the plane including the second tray surface 71 (a first configuration), the direction of the force is closer to a second-guide rotation plane in which the second guides 43 are rotatable than when the rotational axis 17 of the second tray 12 is positioned in the plane including the second tray surface 71 (a second configuration). Therefore, in the first configuration, a component, in a direction along the second-guide rotation plane, of the force applied to the distal end portion 101 of each second guide 43 is greater than in the second configuration. Accordingly, with a smaller force, each second guide 43 is allowed to be rotated from the usage position to the retracted position in response to the movement of the second tray 12 from the open position to the closed position. Thus, it is possible to easily move the second tray 12 from the open position to the closed position.

The second tray 12 includes the opening 19 formed to penetrate in the direction perpendicular to the second tray surface 71. Further, each second guide 43 is formed in such a shape that when in the usage position, the distal end portion 101 thereof is positioned on a side of the rotational axis 17 of the second tray 12 with respect to the opening 19 (i.e., the distal end portion 101 thereof is closer to the rotational axis 17 of the second tray 12 than the opening 19 in the first direction). Thereby, when the second tray 12 is moved from the open position to the closed position, it is possible to prevent the distal end portions 101 of the second guides 43 from being caught on the opening 19. Thus, it is possible to smoothly move the second tray 12 and the second guides 43.

The image reader 1 includes the torsion springs 91 each configured to urge the corresponding second guide 43 toward the usage position from the retracted position. Therefore, when the second tray 12 is moved from the closed position to the open position, it is possible to move each second guide 43 from the retracted position to the usage position with the urging force of each torsion spring 91.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

<Modifications>

In the aforementioned illustrative embodiment, each second guide 43 is configured to rotate between the usage position and the retracted position. Nevertheless, as shown in FIGS. 15 and 16, each second guide 43 may be configured to linearly slide between a usage position and a retracted position. It is noted that, as shown in FIGS. 15 and 16, in this modification, a first direction in which the first tray 11 extends may be defined as a front-to-rear direction of the image reader 1. A side on which the second tray 12 in the open position is placed may be defined as a rear side of the image reader 1. A direction perpendicular to the first tray surface 35 may be defined as a vertical direction. A side toward which the first tray surface 35 faces may be defined as an upside of the image reader 1.

Hereinafter, an explanation will be provided specifically about a right one of width guides 41 with reference to FIGS. 15 and 16. The right and left wide guides 41 are configured to be mirror-symmetric with respect to a plane perpendicular to the left-to-right direction.

A first guide 42 is provided integrally with a first placement portion 121, a first regulation portion 122, and an insertion portion 123.

The first placement portion 121 is formed in a plate shape.

The first regulation portion 122 rises upward from a right end portion of the first placement portion 121 and extends in the front-to-rear direction. A front end portion 124 of the first regulation portion 122 is wider in the left-to-right direction than a rear portion 125 extending rearward from the front end portion 124. A left end face of the front end portion 124 is a first guide surface 126. The first guide surface 126 is formed in a flat surface that is perpendicular to an upper surface of the first placement portion 121 and extends in the front-to-rear direction. Further, in a left end face of the rear portion 125, formed is a slide groove 127 extending in the front-to-rear direction.

The insertion portion 123 protrudes relative to a lower surface of the first placement portion 121 and extends in the left-to-right direction. The insertion portion 123 has the same configuration and the same function as the insertion portion 53 shown in FIGS. 10 and 11.

The second guide 43 is provided integrally with a second placement portion 131 and a second regulation portion 132.

The second placement portion 131 is formed in a plate shape.

The second regulation portion 132 rises upward from the second placement portion 131. An upper surface of the second regulation portion 132 is lower than an upper surface of the first regulation portion 122 of the first guide 42 in a direction perpendicular to the first tray surface 35 (see FIG. 3). Further, the second regulation portion 132 includes a second guide surface 133 disposed substantially in plane with the first guide surface 126 of the first guide 42. Further, the second regulation portion 132 includes a fitting projection (not shown) extending in the front-to-rear direction. The fitting projection is fitted in the slide groove 127 of the first guide 42 and configured to move along the slide groove 127 in the front-to-rear direction. Thereby, the second guide 43 is movable between the usage position (see FIG. 15) and the retracted position (see FIG. 16).

When the tray 3 is in the open position, and each second guide 43 is in the usage position, positions of the two wide guides 41 in the left-to-right direction are adjusted to fit a width of the sheet S in the left-to-right direction. Thereafter, the sheet S is inserted between the two first guide surfaces 126 and between the two second guide surfaces 133, and placed on the first placement portions 51 of the two first guides 42 and the second placement portions 81 of the two second guides 43.

Further, when each second guide 43 is configured to rotate between the usage position and the retracted position, a second placement portion 81 of each second guide 43 may be formed in a shape as shown in FIGS. 17 and 18 (which only show the right second guide 43). Namely, compared with the shape of the second placement portion 81 shown in FIGS. 8 and 9, an angle formed between a second end face 84 and a third end face 85 of the second placement portion 81 shown in FIGS. 17 and 18 may be smaller. Further, a third end face 85 of the right second guide 43 may be positioned on a left side of a straight line L1 connecting a distal end portion 101 and a rotational axis of the right second guide 43.

It is noted that, as shown in FIGS. 17 and 18, in this modification, a first direction in which the first tray 11 extends may be defined as a front-to-rear direction of the image reader 1. A side on which the second tray 12 in the open position is placed may be defined as a rear side of the image reader 1. A direction perpendicular to the first tray surface 35 may be defined as a vertical direction. A side toward which the first tray surface 35 faces may be defined as an upside of the image reader 1.

In the modification shown in FIGS. 17 and 18, when the second tray 12 is moved from the open position to the closed position, it is harder for the second tray 12 to be caught on the second guides 43. Consequently, it is possible to smoothly move the second tray 12 and the second guides 43.

In the aforementioned illustrative embodiments and modifications, each first guide 42 is fixedly attached onto the first tray surface 35 of the first tray 11, and each second guide 43 is movable between the usage position straight above the second tray surface 71 and the retracted position above the first tray surface 35. Nevertheless, each second guide 43 may be fixedly attached onto the second tray 12, and each first guide 42 may be movable between a position straight above the second tray surface 71 and a position above the first tray surface 35.

In the aforementioned illustrative embodiment, each second guide 43 is configured to rotate in the direction (left or right) toward the other second guide 43 from the usage position and be placed into the retracted position. Nevertheless, each second guide 43 may be configured to rotate in a direction opposite to the direction toward the other second guide 43 from the usage position and be placed into a retracted position.

In the aforementioned illustrative embodiment, aspects of the present disclosure are applied to the image reader 1 provided with image processing units such as the first reading unit 114 and the second reading unit 115. Nevertheless, aspects of the present disclosure may be applied to an image forming apparatus that includes an image forming unit (as an example of an image processing unit) configured to form an image on a sheet S. In this case, the image forming unit may be configured to perform image formation in an electrophotographic method or an inkjet method.

What is claimed is:

1. An image processing apparatus, comprising;

a housing;

an image processing unit disposed in the housing;

a first tray disposed at the housing, the first tray having a first tray surface;

a second tray rotatably supported by the first tray, the second tray having a second tray surface;

a first guide configured in one of:

a first manner that the first guide is disposed on the first tray surface and extends in a first direction, the first direction being perpendicular to a rotational axis of the second tray and parallel to the first tray surface; and a second manner that the first guide is disposed on the second tray surface and extends in a second direction the second direction being perpendicular to the rotational axis of the second tray and parallel to the second tray surface; and a second guide connected with the first guide, the second guide being configured to move between a first position where the second guide faces the first tray surface in a direction substantially perpendicular to the first tray surface and a second position where the second guide faces the second tray surface in a direction substantially perpendicular to the second tray surface;

wherein the is disposed on the first tray surface and extends in the first direction;

wherein the housing comprises a sheet feeding port formed to be open in the first direction, on an opposite side of the second tray with respect to the first tray, and wherein the second guide is configured to move between the first position and the second position, by rotating around a rotational axis extending in a direction intersecting the first tray surface.

2. The image processing apparatus according to claim 1, wherein the first guide is disposed at each individual one of two sides of the first tray in a width direction along the rotational axis of the second tray, wherein the second guide is provided in correspondence with each individual one of the first guides, and wherein each of the second guides is configured to rotate around the rotational axis extending in the direction intersecting the first tray surface between:

the first position where the second guides extend toward each other from the respective rotational axes thereof along the width direction over the first tray surface; and the second position where each second guide extends from the rotational axis thereof along the first direction over the second tray surface.

3. The image processing apparatus according to claim 2, wherein at least one of the first guides is configured to move along the width direction, and wherein a sum of lengths of the second guides in the width direction is less than a distance between the rotational axes of the second guides, in a state where the first guides are closest to each other, and each second guide is in the first position.

4. The image processing apparatus according to claim 1, wherein the second guide is formed with a height less than a height of the first guide in a direction along the rotational axis of the second guide.

5. The image processing apparatus according to claim 1, wherein the first guide is disposed at each individual one of two sides of the first tray in a width direction along the rotational axis of the second tray, wherein the second guide is provided in correspondence with each individual one of the first guides, wherein the second tray is configured to rotate between an open position where the second tray is open relative to the first tray surface and a closed position where the second tray is closed relative to the first tray surface, and wherein each of the second guides is configured to, when the second tray is in the open position, rotate between:

the first position where the second guides extend toward each other along the width direction over the first tray surface; and the second position straight above the second tray surface.

6. The image processing apparatus according to claim 5, wherein each of the second guides is formed in such a shape that, when each second guide is in the second position, a distal end portion of one second guide of the second guides is positioned closer to an other second guide in the width direction than the rotational axis of the one second guide, the distal end portion being farthest away from the rotational axis of the one second guide than any other portion of the one second guide.

7. The image processing apparatus according to claim 6, wherein each second guide comprises a slanted portion, the slanted portion extending from the distal end portion of a corresponding second guide in a manner slanting toward the rotational axis of the corresponding second guide with respect to the width direction, when the corresponding second guide is in the second position.

8. The image processing apparatus according to claim 7, wherein the slanted portion of the one second guide is formed on an opposite side of the other second guide in the width direction with respect to a straight line connecting the rotational axis of the one second guide with the distal end portion of the one second guide, when the one second guide is in the second position.

9. The image processing apparatus according to claim 7, wherein the slanted portion of the one second guide is formed on a side of the other second guide in the width direction with respect to a straight line connecting the rotational axis of the one second guide with the distal end portion of the one second guide, when the one second guide is in the second position.

10. The image processing apparatus according to claim 6, wherein the rotational axis of the second tray is positioned on a side of the second guides with respect to a plane including the second tray surface when the second tray is in the open position.

11. The image processing apparatus according to claim 6, wherein the second tray comprises a through-hole penetrating in the direction substantially perpendicular to the second tray surface, and wherein the distal end portion of the second guide in the second position is disposed between the rotational axis of the second tray and an end portion of the through-hole in the first direction, the end portion defining an end position of the through-hole on a side close to the rotational axis of the second tray in the first direction.

12. The image processing apparatus according to claim 5, further comprising urging members each of which is configured to urge a corresponding one of the second guides from the first position toward the second position.

13. An image processing apparatus comprising:

a housing;

an image processing unit disposed in the housing;

a first tray disposed at the housing, the first tray having a first tray surface;

a second tray rotatably supported by the first tray, the second tray having a second tray surface;

a first guide disposed on the first tray surface, the first guide extending in a first direction perpendicular to a rotational axis of the second tray and parallel to the first tray surface; and a second guide connected with the first guide, the second guide being configured to rotate around a rotational axis extending in a direction substantially perpendicular to the first tray surface, between a first position where the second guide faces the first tray surface in the direction substantially perpendicular to the first tray surface and a second position where the second guide faces the second tray surface in a direction substantially perpendicular to the second tray surface.

14. The image processing apparatus according to claim 13, wherein the housing comprises a sheet feeding port formed to be open in the first direction, on an opposite side of the second tray with respect to the first tray wherein the first guide is disposed at each individual one of two sides of the first tray in a width direction along the rotational axis of the second tray, wherein the second guide is provided in correspondence with each individual one of the first guides, and wherein each of the second guides is configured to rotate around the rotational axis extending in the direction substantially perpendicular to the first tray surface between:

the first position where the second guides extend toward each other from the respective rotational axes thereof along the width direction over the first tray surface; and the second position where each second guide extends from the rotational axis thereof along the first direction over the second tray surface.

15. The image processing apparatus according to claim 14, wherein at least one of the first guides is configured to move along the width direction, and wherein a sum of lengths of the second guides in the width direction is less than a distance between the rotational axes of the second guides, in a state where the first guides are closest to each other, and each second guide is in the first position.

16. The image processing apparatus according to claim 13, wherein the second guide is formed with a height less than a height of the first guide in a direction along the rotational axis of the second guide.

17. The image processing apparatus according to claim 13, wherein the first guide is disposed at each individual one of two sides of the first tray in a width direction along the rotational axis of the second tray, wherein the second guide is provided in correspondence with each individual one of the first guides, wherein the second tray is configured to rotate between an open position where the second tray is open relative to the first tray surface and a closed position where the second tray is closed relative to the first tray surface, and wherein each of the second guides is configured to, when the second tray is in the open position, rotate between:

the first position where the second guides extend toward each other along the width direction over the first tray surface; and the second position straight above the second tray surface.

18. The image processing apparatus according to claim 17, wherein each of the second guides is formed in such a shape that, when each second guide is in the second position, a distal end portion of one second guide of the second guides is positioned closer to another second guide in the width direction than the rotational axis of the one second guide, the distal end portion being farthest away from the rotational axis of the one second guide than any other portion of the one second guide.

19. The image processing apparatus according to claim 18, wherein each second guide comprises a slanted portion, the slanted portion extending from the distal end portion of a corresponding second guide in a manner slanting toward the rotational axis of the corresponding second guide with respect to the width direction, when the corresponding second guide is in the second position.

20. The image processing apparatus according to claim 18, wherein the rotational axis of the second tray is positioned on a side of the second guides with respect to a plane including the second tray surface when the second tray is in the open position.

* * * * *